US006721982B2

(12) United States Patent
Freeman

(10) Patent No.: US 6,721,982 B2
(45) Date of Patent: Apr. 20, 2004

(54) QUILT-STITCHED INTERNAL MATTRESS PILLOWS

(75) Inventor: William Freeman, Highpoint, NC (US)

(73) Assignee: Sealy Technology LLC, Trinity, NC (US)

( * ) Notice: Subject to any disclaimer, the term of this patent is extended or adjusted under 35 U.S.C. 154(b) by 0 days.

(21) Appl. No.: 10/106,001

(22) Filed: Mar. 25, 2002

(65) Prior Publication Data

US 2003/0177583 A1 Sep. 25, 2003

(51) Int. Cl.[7] ..... A47C 27/05; A47C 31/02

(52) U.S. Cl. ..... 5/721; 5/716

(58) Field of Search ..... 5/721, 716, 737, 5/500

(56) References Cited

U.S. PATENT DOCUMENTS

| | | | | | |
|---|---|---|---|---|---|
| 1,238,302 | A | * | 8/1917 | Kronlund | 5/721 |
| 1,835,212 | A | * | 12/1931 | Fowler | 5/721 |
| 1,859,341 | A | * | 5/1932 | Marsack | 5/721 |
| 1,898,573 | A | * | 2/1933 | Schubert | 5/721 |
| 1,973,651 | A | * | 9/1934 | Odets | 5/721 |
| 2,215,784 | A | * | 9/1940 | Foster | 5/721 |
| 2,216,537 | A | * | 10/1940 | Martin | 5/721 |
| 2,218,478 | A | * | 10/1940 | Patton | 5/721 |
| 2,454,220 | A | * | 11/1948 | Seeche | 5/721 |
| 3,249,952 | A | * | 5/1966 | Janapol | 5/716 |
| 3,274,625 | A | * | 9/1966 | Metzger | 5/737 X |
| 4,019,451 | A | * | 4/1977 | Autrey | 112/475.08 |
| 4,075,721 | A | * | 2/1978 | Autrey | 5/716 |
| 4,463,466 | A | | 8/1984 | May et al. | |
| 4,754,514 | A | * | 7/1988 | Limb et al. | 5/502 |
| 4,782,540 | A | * | 11/1988 | Parker | 5/737 X |
| 4,961,238 | A | * | 10/1990 | Limb et al. | 5/500 |
| 4,972,534 | A | * | 11/1990 | Hutton | 5/668 |
| 5,109,559 | A | * | 5/1992 | West | 5/668 |
| 5,285,542 | A | * | 2/1994 | West et al. | 5/500 |
| 5,317,768 | A | | 6/1994 | Klancnik | |
| 5,319,814 | A | | 6/1994 | Dyer, Jr. | |
| 5,398,355 | A | * | 3/1995 | Bailey | 5/500 |
| 5,469,590 | A | | 11/1995 | Simon | |
| 5,475,881 | A | * | 12/1995 | Higgins et al. | 5/737 |
| 5,523,144 | A | | 6/1996 | Dyer, Jr. | |
| 5,568,659 | A | * | 10/1996 | Fogel | 5/737 |
| 5,655,241 | A | * | 8/1997 | Higgins et al. | 5/737 |
| 5,787,532 | A | | 8/1998 | Langer et al. | |
| 5,794,289 | A | | 8/1998 | Wortman et al. | |
| 5,974,609 | A | * | 11/1999 | Nunez et al. | 5/721 X |
| 6,023,803 | A | * | 2/2000 | Barman | 5/721 X |
| 6,099,951 | A | | 8/2000 | Flick et al. | |
| 6,574,815 | B2 | * | 6/2003 | Freeman et al. | 5/716 |
| 2003/0097715 | A1 | * | 5/2003 | Barman | 5/716 |
| 2003/0177583 | A1 | * | 9/2003 | Freeman | 5/721 |

* cited by examiner

*Primary Examiner*—Robert G. Santos
(74) *Attorney, Agent, or Firm*—Roetzel & Andress

(57) ABSTRACT

A mattress has a quilted internal pillow wherein one or more internal layers of material are quilt-stitched prior to encapsulation in mattress upholstery. The quilted internal pillow is positioned relative to a support surface of an innerspring or spring core of a mattress to provide support characteristics determined by the quilt stitch pattern. In a related method of manufacture of a mattress with an internal quilt stitched pillow, the layer or layers of the pillow are processed through a quilter stitching machine and then assembled in combination with a mattress spring core and upholstery. The quilted internal pillow may be located adjacent to the spring core, spaced from the spring core by other internal layers of material, or located adjacent to or within a mattress pillowtop, and in each embodiment on one or both sides of the mattress.

20 Claims, 4 Drawing Sheets

QUILT-STITCHED INTERNAL MATTRESS PILLOWS

FIELD OF THE INVENTION

The present invention pertains generally to cushioned and upholstered support structures and, more particularly, to support structures which have multiple internal and assembled components.

BACKGROUND OF THE INVENTION

A typical innerspring mattress includes an innerspring assembly having an array of interconnected coils of helical wire or other type of reflexive elements, one or more layers of material over the support surfaces of the innerspring, one or more layers of polymer foam over the support surfaces of the innerspring, and an upholstery layer covering these components. In a two-sided mattress, the support surfaces of both sides of the innerspring are covered with one or more layers of polymer foams, fiber batting and fabric layers of material such as cotton or wool. The internal layers are then encased in upholstery which is typically a quilted exterior layer, also referred to simply as upholstery or ticking. The seams of the upholstery layer are sewn together (often with tape edging) about the perimeter of the support surfaces. The edge or border of the innerspring between the support surfaces is similarly covered with upholstery, the edges of which are sewn to the edges of the support surface covers with a tape edge.

The upholstery material commonly has a quilted stitch pattern and a foam backing. This quilt stitch pattern is provided either by the upholstery material manufacturer, or in a mattress factory equipped with a quilt stitching machine, such as a Gribetz International, Kaybe, Emco or Matramatic type automated quilting machine, which have a linear array of controllable/programmable sewing needles and is programmable to sew any desired pattern into a swatch of material as it is passed under the array of needles. The decorative nature of the stitch pattern lends itself to application on the upholstery layer. However, any type or combinations of material penetrable by the the needles of the quilter are able to be sewn by such quilting machines. Prior to this invention, few if any applications of quilting machines have been made to the stitching of non-upholstery material layers or to any materials installed in the interior of a mattress.

Cushioning layers underneath the upholstery, including high density foam and man made fiber batts, in combination with other padded or quilted upholstery layers, can make the mattress very bulky and rounded at the edges. As a result, it is difficult to sew together the seams around the periphery of the mattress. This requires expert operation of a large tape edge stitching machine mounted at an oblique angle to the mattress. The sewing head must traverse the entire perimeter of the mattress, while keeping the internal layers of material in alignment. Thus, as the perimeter of the upholstery layer is stitched by the quilting machine, the cushioning layers within the mattress tend to shift, shifting the dimensions of the mattress as well. This is especially true of double-sided mattresses, with layers of cushioning material on both sides of the spring assembly. As the mattress layers shift, the dimensions of the mattress are skewed and the finished shape of the mattress is distorted. A method and construction for maintaining alignment of internal layers of a mattress during and after assembly is therefore desirable.

Additional objects, advantages and novel features of the invention will be set forth in part in the description which follows, and in part will become apparent to those skilled in the art upon examination of the following or may be learned by practice of the invention. The objects and advantages of the invention may be realized and attained by various structures as covered by the patent claims.

SUMMARY OF THE PRESENT INVENTION

The present invention provides a quilted internal mattress pillow which enhances dimensional stability of the mattress construction by quilt stitching one or more layers of internal material prior to installation or encapsulation by the mattress upholstery. By quilt stitching internal layers together, the alignment of the layers is maintained during final assembly and thereafter, and the support characteristics of the quilt-stitched internal layers are altered according to the stitch pattern. The quilted internal layer or layers do not shift relatively during stitching of the seams of the upholstery layer. In another aspect of the invention of quilt-stitching together internal layers of a mattress prior to assembly, the body of the quilted internal pillow may also contain a concentration of stitches in the lumbar or other areas to customize the support characteristics of the mattress.

In accordance with one general aspect of the invention, there is provided a quilted internal pillow which has at least one layer of supporting material and at least one layer of backing material quilted together prior to installation in a mattress. In one particular embodiment, the quilt-stitched internal layers are foam layers, and in a further embodiment one of the internal layers has a thickness or density greater than the other internal layer to which is it attached. One or more of the internal layers may be in the shape of a slab or planar piece, or have a convoluted surface, illustrating the principle that material layers of different configurations can be quilt-stitch attached to other layers by processing through automated quilt stitching machinery. Further, the quilting is performed by stitching the internal pillow, wherein the stitches extend through all layers of the quilted pillow to prevent lateral, longitudinal or sliding movement of the layers during handling and installation into the mattress.

The quilt stitching is preferably in a pattern or matrix located within the perimeter of the layers of the internal pillow, as compared to an edge or perimeter stitch. However, some of the stitches of the quilt-stitch pattern may be located proximate to the edges of the internal pillow layers so that the layers are adequately secured throughout. The quilt-stitching may be more concentrated in selected areas such as the lumbar area, thus, the higher concentration of stitching would create more density and support in that specific region. The internal quilted pillow is then inserted into a mattress between the upholstery layer and the spring assembly. The spring assembly includes an innerspring made of a plurality of springs or coils connected together in an array. In the case of a double-sided mattress, a second quilted internal pillow is inserted on the other side of the spring assembly, opposite to the first internal pillow to create a mattress with symmetrical sides of cushioning.

In accordance with another aspect of the invention, there is provided a quilted internal pillow which has at least one layer of supporting material and at least one layer of backing material quilted together and then inserted into a mattress. The quilted internal pillow is inserted into the mattress as a part of the pillow top. The innerspring is encased in the upholstery layer and stitched together. Thus, the mattress is stitched together by stitching the perimeter seams of the gusset and the pillow top together.

In an associated method of mattress manufacture of the present invention, a new use for the quilting machine is described. In the prior art, automated quilting machines are used exclusively to quilt-stitch the exterior upholstery layer of a mattress before it is installed as a cover over an innerspring and other materials. The present invention utilizes the quilting machine for quilt stitching together multiple layers of an internal mattress pillow, prior to installation of the pillow in a mattress. The quilt stitch patterns which may be used in the manufacture of the internal mattress pillows of the invention can be any of the patterns producible by the available machinery and control systems and software, and functional as attachment or fastening, and to alter the support characteristics of the internal mattress pillow.

These and other aspects of the present invention are herein described in further detail, with reference to the accompanying Figures, the illustrated embodiments being representative of only some of they ways in which the principles and concepts of the invention can be executed and employed.

DETAILED DESCRIPTION OF PREFERRED AND ALTERNATE EMBODIMENTS

Figure 1:
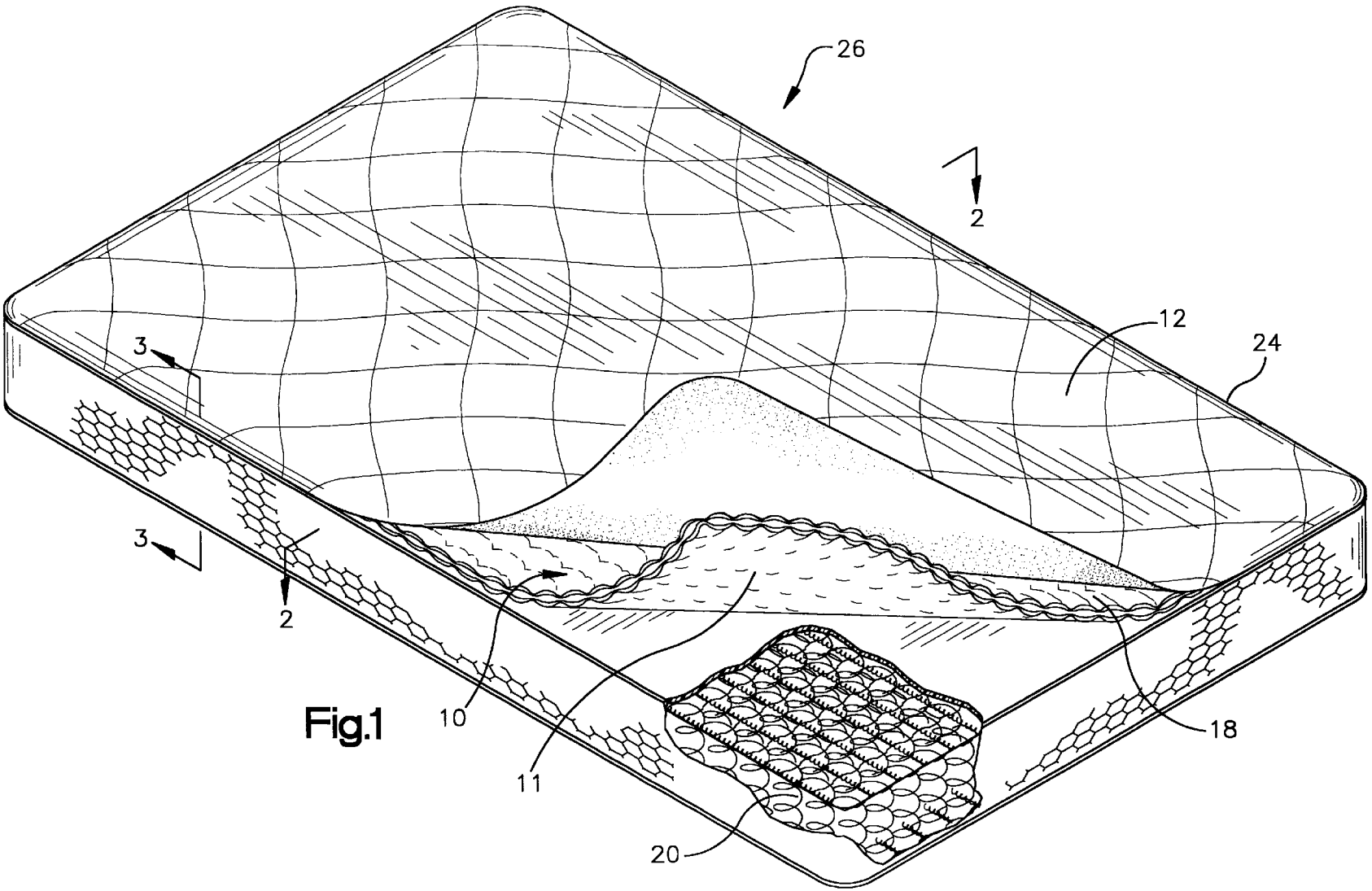
FIG. 1 is a perspective peel-away view of an entire mattress, showing the internal pillow quilted together.

With reference to the Figures, there is shown a mattress 5 which includes an internal pillow, generally indicated at 10, which includes in one embodiment at least one layer of material 28 and a second or third layer of material 30, each of the layers being quilt-stitched together. Although referred to herein as a "pillow", the internal quilt-stitched layer or layers 10 may be in any particular form, size or shape, the primary physical characteristic being one or more layers which are sewn together in a quilt stitch pattern prior to insertion or inclusion in the interior of a mattress, i.e., inside of the upholstery of the mattress. The central layer of material 28 may be a foam layer, such as slab or convoluted foam, or any other suitable material, but which preferably has some compressible thickness or loft, with an appropriate density to function as an internal mattress pillow. The outer layer or layers 30 of the pillow 10 may be similar to layer 28, or alternatively a fiber batt or other woven or non-woven sheet material. In a single layer embodiment, quilt stitching is placed throughout the area of the single layer to alter the spatial density and support characteristics of the layer. As used herein, the term quilt stitching refers to any stitch pattern which can be made in the internal pillow layers, as made by the described commercial quilt stitching machines, and which is located within the perimeter of the layer or layers, and which is in any pattern within the area of the layer or layers.

Figure 2:
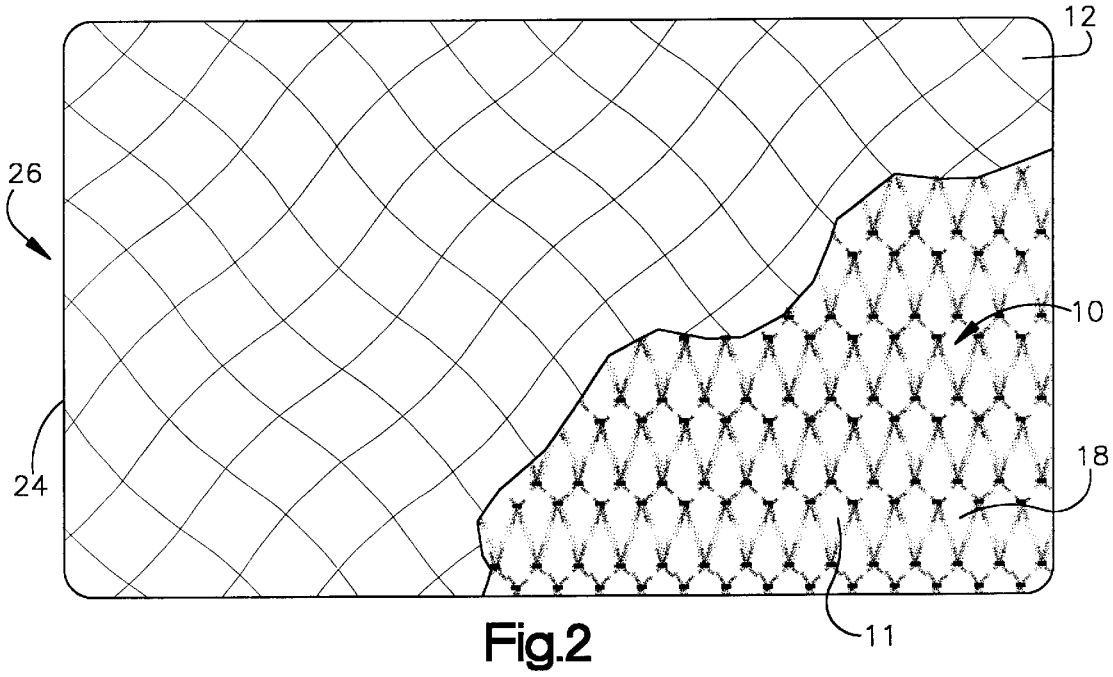
FIG. 2 is a top view of the quilted internal pillow of the present invention.
Figure 3:
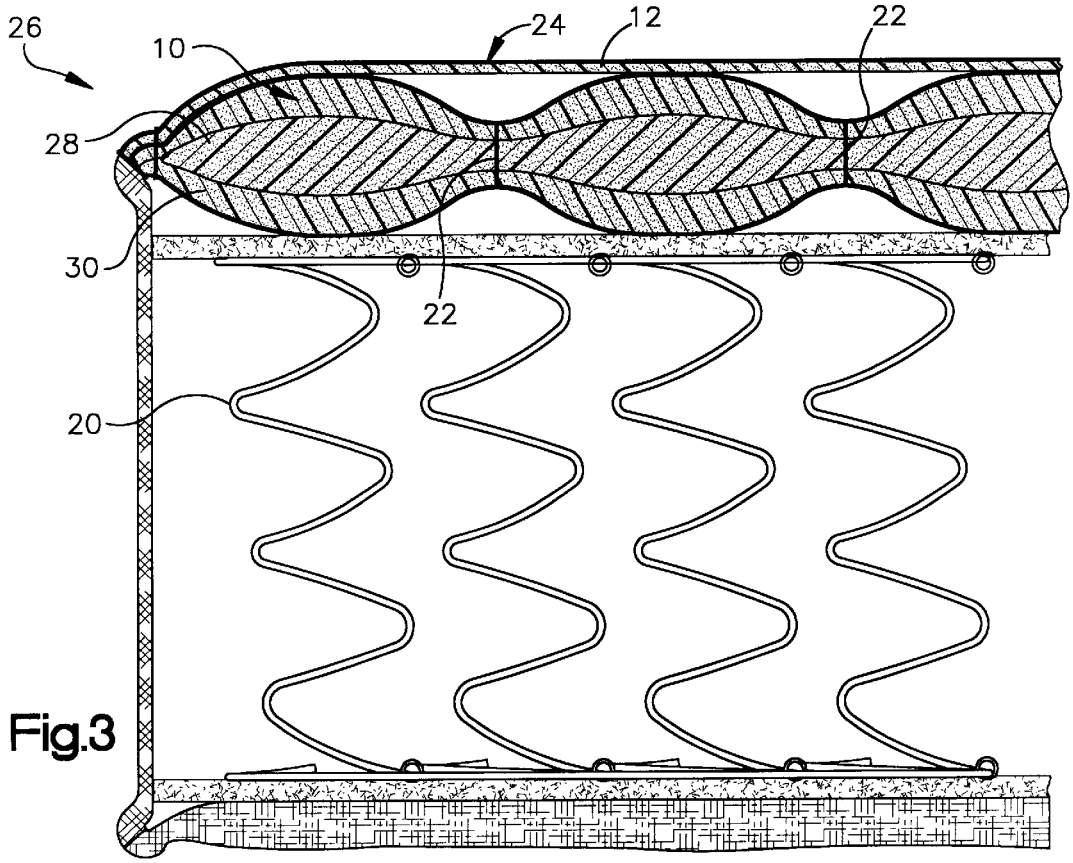
FIG. 3 is an elevational cross-sectional view of an entire mattress, showing the internal pillow quilted together.

As shown in FIG. 2, quilt stitching 18 is placed throughout the expanse or surface area of the internal pillow 10, with the stitches 22 extending substantially through the cross-section of layers 28 and 30 to thereby stitch and retain them together. As further described, the internal quilted pillow 10 is quilted prior to insertion into a mattress 5 to prevent lateral, longitudinal or sliding movement of the supporting and backing layers 28 and 30 when in contact with the upholstery layer 12. Additionally, the quilt stitching 22 in the body 11 of the internal pillow 10 can be used to control the density and support of specific areas of the mattress 5. Stitches 22 can be concentrated in different areas on the body 11 of the internal pillow 10, depending on the needs of the user. In areas where there is a higher concentration of stitches 22, the internal pillow 10 would exhibit more density and support. For example, a higher concentration of stitches 22 may be added to the lumbar area to create more density and more support for user's that have chronic sore back muscles. Thus, the amount of stitches 22 quilted into the body 11 of the internal pillow 10 allows for varying degrees of density and support.

Once the layers 28 and 30 of the internal pillow 10 are quilt-stitched together, they are inserted into a mattress 5, as shown in FIG. 1. According to one embodiment of the present invention, the internal pillow 10 is inserted into a mattress 5 between the upholstery layer 12 and the mattress innerspring 20. The internal pillow 10 is dimensioned to fit upon and substantially cover the support surface area of the innerspring, which may be any form of an array of interconnected spring coils 20.

The innerspring 20 and internal quilted pillow 10 are encapsulated or covered by an outer upholstery cover layer 12, which extends over the planar support surfaces of the innerspring and about the perimeter or border of the innerspring. The upholstery 12 is commonly made of a woven fabric material, which is also commonly decoratively embroidered, and may also have a quilted stitch pattern which secures a padded backing layer, such as a thin foam layer, to the back side of the upholstery. This type of external upholstery quilt stitch pattern, however, is distinguished from the internal quilt stitch pattern of the internal pillow layers of the present invention.

Once the internal pillow 10 is properly positioned within the mattress 5, the perimeter seams 24 of the upholstery layer 12 are then stitched together, retaining the internal pillow 10 within the mattress 5. The panels and border of the upholstery material 12 are joined at the edges by perimeter seams 24, which may include a surrounding tape edge. The quilt pre-stitching of the layers 28 and 30 of the internal pillow 10 before insertion into the mattress 5 provides dimensional stability of all the cushioning components, and thereby avoids the manufacturing step of maintaining alignment even overlay of the internal layers as the upholstery is applied. As the perimeter seams 24 of the upholstery layer 12 are stitched together, the quilt stitching of the internal pillow 10 retains the layers 28 and 30 in proper positional and planar alignment. Thus, the internal cushioning layers will not shift during assembly of the mattress 5.

Figure 4:
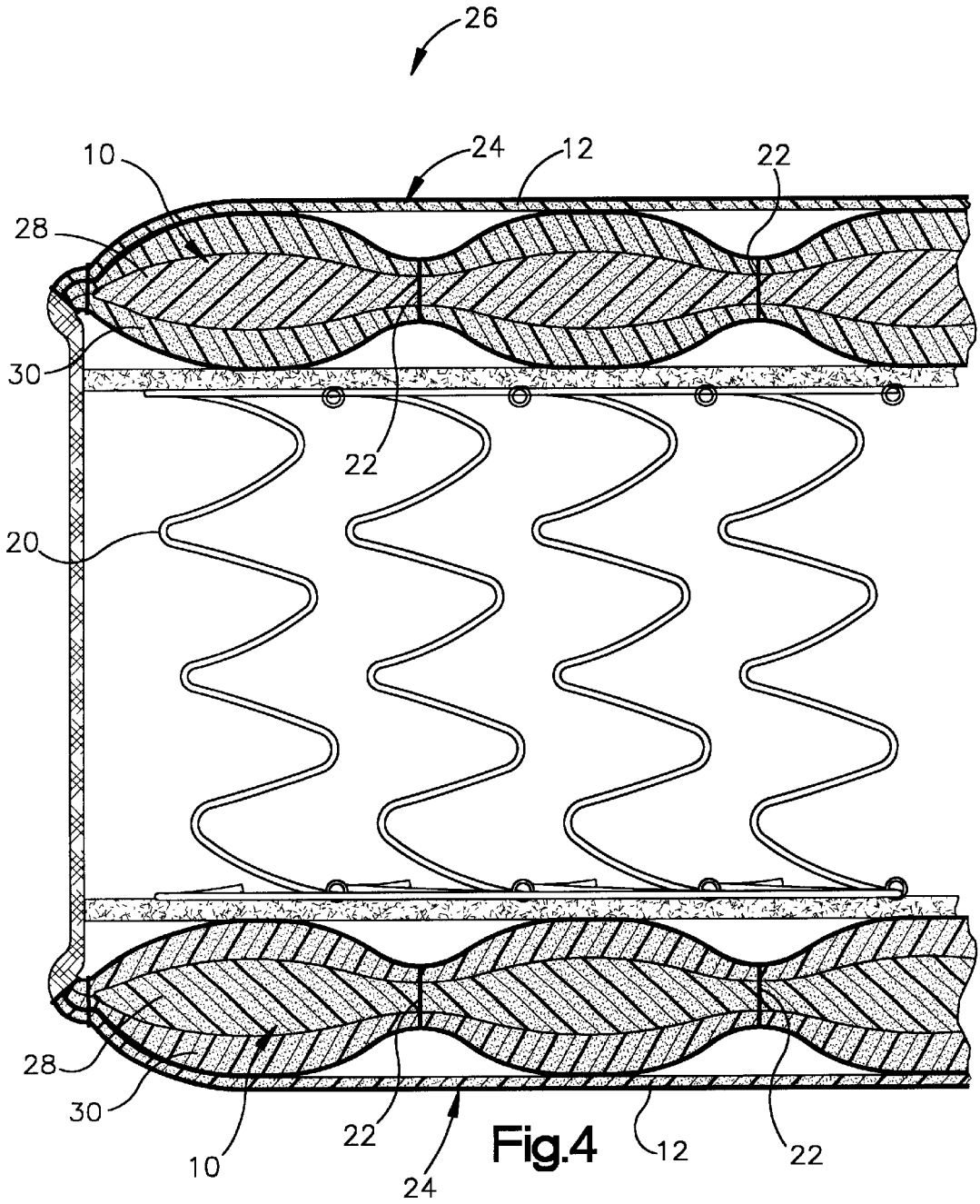
FIG. 4 is an elevational cross-sectional view of a double-sided mattress, showing the internal pillow quilted together.

As shown in FIG. 4, in a double-sided mattress, a second quilted internal pillow 10 can be provided on an opposite side of the innerspring 20, opposite to the first internal pillow 10. Once the quilted internal pillow(s) 10 are in position, the perimeter seams 24 of the upholstery layer 12 are then stitched to retain the internal pillows 10 within the mattress 5. The layers 28 and 30 of both internal pillows 10 are quilted together prior to insertion in the mattress 5 as previously described.

Figure 5:
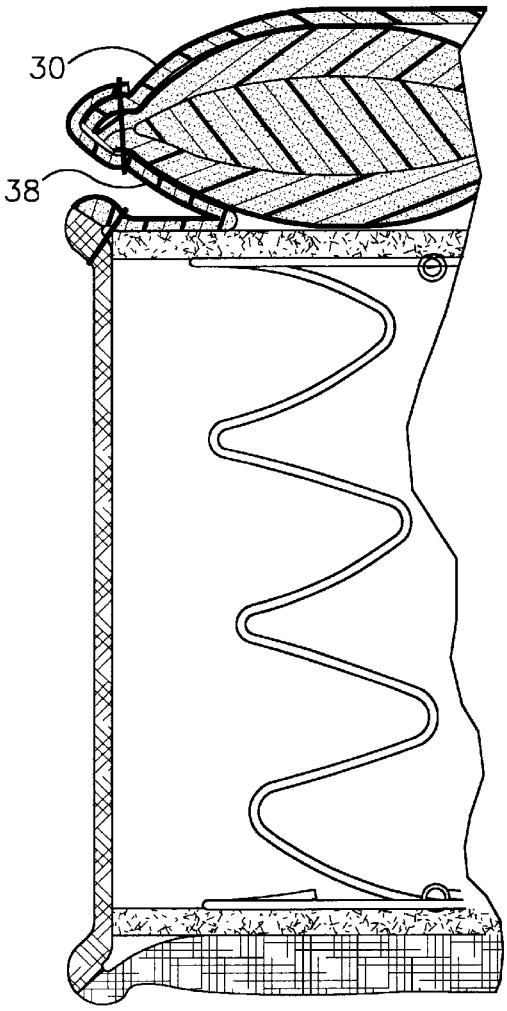
FIG. 5 is a perspective view of the quilted internal pillow inserted in the mattress as part of the pillow top.
Figure 6:
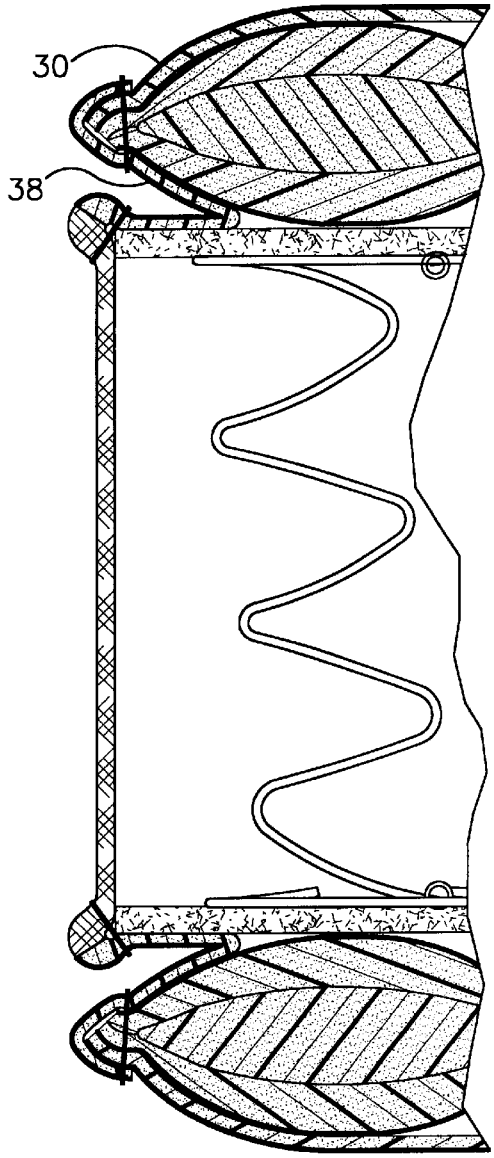
FIG. 6 is a cross-sectional view of a double-sided pillow-top mattress with quilted internal pillows of the present invention.

Referring now to FIGS. 5 and 6, in another embodiment of the present invention, the internal pillow 10 is inserted into a mattress 5 as an internal component of a mattress pillow top 36. The spring assembly 20 is encapsulated by an outer upholstery cover 12 and stitched together. One manner of attachment of the pillow top 36 is by a gusset 38 is sewn along the perimeter of the mattress 5, either to a border or to the top of an inner panel which covers the innerspring. The edges of a top upholstery layer are then sewn to the edges of the gusset. Another type of pillow top attachment is to adhesively attach a gusset to the innerspring covering and to the pillow top covering upholstery. The quilted internal pillow of the invention can be installed in connection with a pillow top in these or other equivalent manners, whereby the quilted internal pillow 10 is an integral internal component of a mattress pillow top. As in the first embodiment, the layers 28 and 30 of the internal pillow 10 are quilt stitched together prior to installation in the mattress 5.

As shown in FIG. 6, in a double-sided mattress, a second quilted internal pillow 10 can be inserted as a part of the pillow top 36 on the other side of the innerspring 20, opposite to the first internal pillow 10. Once the quilted internal pillow(s) 10 are in position, the pillow tops 36 are integrally constructed over or in connection with the internal pillow 10. The perimeter seams 24 of the gusset 38 and the pillow top 36 are top stitched or surged together to retain the internal pillows 10.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Other features and aspects of this invention will be appreciated by those skilled in the art of designing and manufacturing mattresses upon reading and comprehending this disclosure. Such features, aspects, and expected variations and modifications of the reported results and examples are clearly within the scope of the invention where the invention is limited solely by the scope of the following claims.

What is claimed as the invention is:

1. A mattress comprising:

an innerspring;

a quilted internal mattress pillow having at least two planar layers of material which are in planar contact, with a quilt stitch pattern in a major expanse of the layers, stitches of the quilt stitch pattern extending through the layers to hold the layers together and to maintain alignment of the layers;

the internal mattress pillow being placed adjacent to a support surface of said innerspring, the internal mattress pillow being positioned within a perimeter defined by said support surface of the innerspring and not extending over a side wall of the innerspring encapsulated with the innerspring within upholstery material.

2. The mattress of claim 1 wherein the quilted internal pillow comprises three layers, and wherein stitches of the quilt stitch pattern extend through all three layers.

3. The mattress of claim 1 wherein the quilted internal pillow is located adjacent to the support surface of the innerspring.

4. The mattress of claim 1 wherein the internal pillow is retained within the mattress by a perimeter seam of the upholstery layer about said perimeter of the innerspring.

5. The mattress of claim further comprising a second internal mattress pillow on an opposite support side of the innerspring.

6. The mattress of claim 1 wherein the layers of material of the internal quilted pillow are foam material.

7. The mattress of claim 6 wherein at least one of the layers of the internal quilted pillow has a density different than another layer.

8. The mattress of claim 1 wherein the layers of the internal quilted pillow are generally planar and are generally aligned with a plane of the support surface of the innerspring.

9. The mattress of claim 1 wherein at least one of the layers of the internal quilted pillow has a contoured surface.

10. The mattress of claim 1 wherein quilt stitches in the quilted internal mattress pillow are variable in number and placement across the area of the quilted internal pillow.

11. The mattress of claim 1 wherein the quilted internal pillow is a component of a mattress pillowtop.

12. The mattress of claim 11 wherein the quilted internal mattress pillow is at least partially encapsulated by a gusset attached to an upholstery layer.

13. The mattress of claim 1 further comprising a mattress pillowtop, wherein the quilted internal pillow underlies the mattress pillowtop.

14. The mattress of claim 13 wherein the quilted internal pillow is retained within the mattress by attachment of a mattress pillowtop to a perimeter of the mattress upholstery.

15. The mattress of claim 13 further comprising a second mattress pillowtop and a second quilted internal pillow which underlies the second mattress pillowtop.

16. The mattress of claim 1 wherein the quilted internal pillow comprises three layers including a central layer and two outer layers, with the central layer having a thickness or density greater than a thickness or density of at least one of the outer layers.

17. A mattress comprising:

an innerspring having two parallel planar support surfaces;

a quilted internal pillow placed to substantially overlie a planar support surface of the innerspring and located within a perimeter defined by said support surface of the innerspring, the quilted internal pillow having at lest two layers of material which are attached together by a patterned quilt stitch substantially throughout the area of each layer;

the quilted internal pillow being quilt stitched together prior to encapsulation in upholstery material about an exterior of the mattress.

18. The mattress of claim 17 further comprising a second quilted internal pillow positioned on a side of the innerspring opposite the other quilted internal pillow.

19. The mattress of claim 17 further comprising at least one additional layer of material between a support surface of the innerspring and the quiled.

20. The mattress of claim 17 wherein the quilted internal pillow is located proximate to a pillowtop of the mattress.

* * * * *